United States Patent [19]

Felstet

[11] 4,038,766

[45] Aug. 2, 1977

[54] EXCAVATOR BUCKET RIPPER TOOL

[76] Inventor: Rickerd M. Felstet, Box 341, East Helena, Mont. 59635

[21] Appl. No.: 643,889

[22] Filed: Dec. 23, 1975

[51] Int. Cl.[2] ..... E02F 3/76

[52] U.S. Cl. ..... 37/141 T; 37/DIG. 3; 37/117.5; 172/751; 299/67

[58] Field of Search ..... 37/141 R, 141 T, 142 R, 37/117.5, 103; 172/713, 751, 247, 777; 214/145 R, DIG. 5; 299/67

[56] References Cited

U.S. PATENT DOCUMENTS

| | | | |
|---|---|---|---|
| 2,262,415 | 11/1941 | Williams et al. | 172/777 |
| 2,652,640 | 9/1953 | Schield | 37/142 R |
| 2,838,856 | 6/1958 | Buisse | 37/142 R |
| 2,969,966 | 1/1961 | Matheis | 37/141 R |
| 3,039,210 | 6/1962 | Slaughter | 37/117.5 |
| 3,057,496 | 10/1962 | Garske | 37/117.5 |
| 3,469,330 | 9/1969 | Hood et al. | 37/141 R X |
| 3,596,996 | 8/1971 | Carter | 37/117.5 X |
| 3,724,899 | 4/1973 | Clark | 37/117.5 X |
| 3,854,608 | 12/1974 | Arnold | 37/117.5 X |
| 3,942,271 | 3/1976 | George | 37/117.5 |

FOREIGN PATENT DOCUMENTS

| | | | |
|---|---|---|---|
| 1,095,756 | 5/1958 | Germany | 37/141 R |
| 258,136 | 12/1970 | U.S.S.R. | 37/141 R |

*Primary Examiner*—E. H. Eickholt
*Attorney, Agent, or Firm*—A. Yates Dowell, Jr.

[57] ABSTRACT

A ripper tool apparatus detachably mounted on a conventional excavator bucket so as to distribute the stresses developed as the implement is used. The apparatus includes a central ripper tooth to break hardened or dense earthen material and a pair of side wall cutter teeth to clean the excavated trench walls.

4 Claims, 4 Drawing Figures

FIG. 1
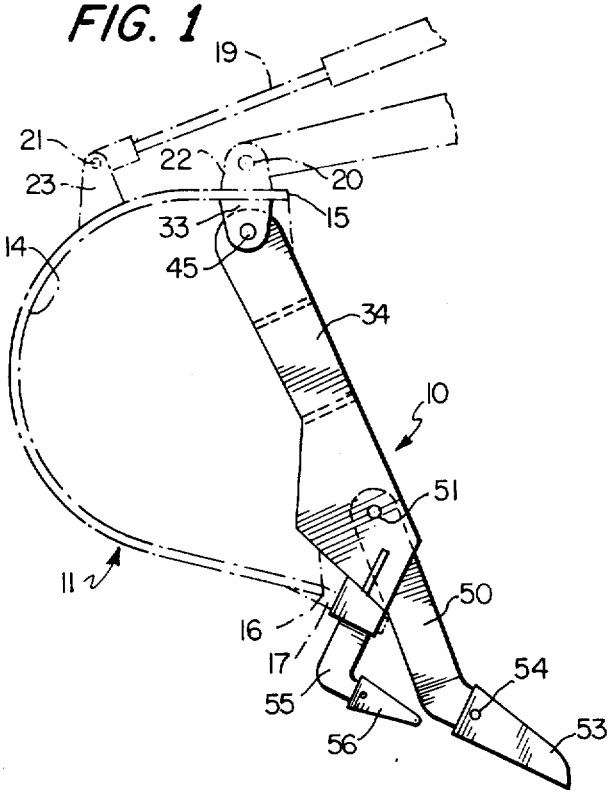
FIG. 2
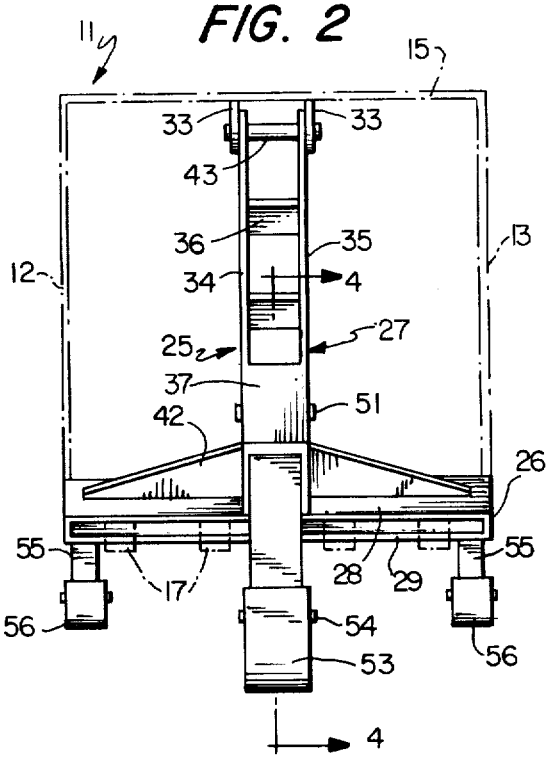
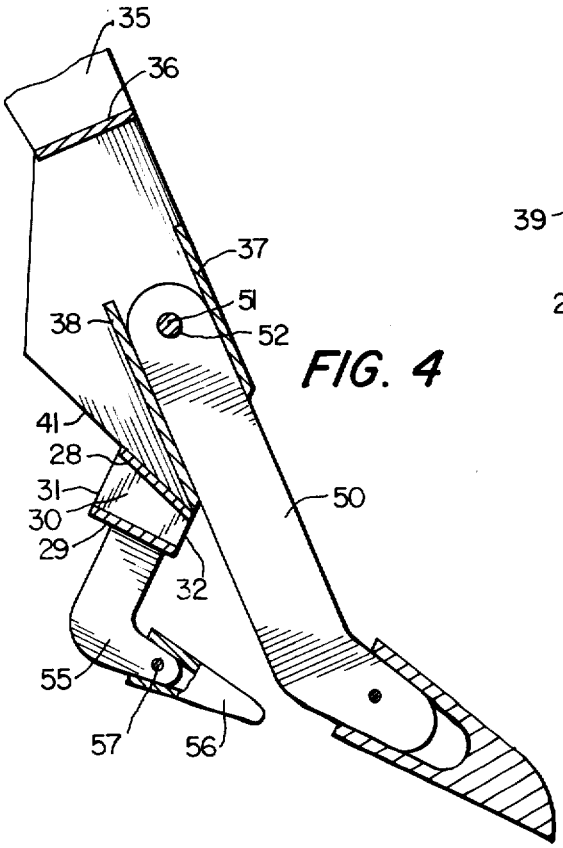
FIG. 4
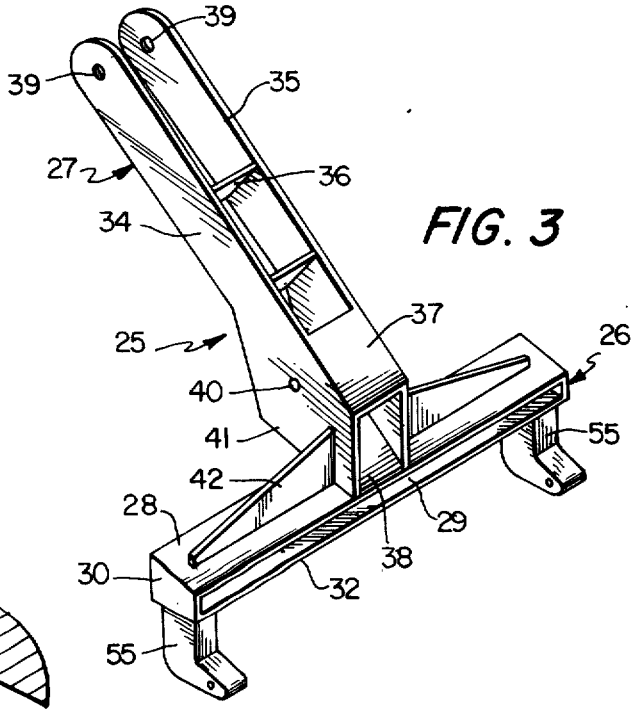
FIG. 3

EXCAVATOR BUCKET RIPPER TOOL

BACKGROUND OF THE INVENTION

1. Field of the Invention

This invention relates generally to earth-working equipment and particularly to a detachably mounted ripper tool for a conventional excavator type bucket.

2. History of the Prior Art

When utilizing conventional backhoe type equipment, it is not uncommon that the excavation operations are complicated by poor soil conditions. Often the ground to be worked is frozen, rocky, or simply extremely well packed or dense. In such instances, some means must be provided to break up the hardened earthen material before a backhoe bucket or scoop can be used to excavate the same.

Heretofore, numerous cutting and ripping attachments have been designed either for use with or attachment to backhoe or other excavator buckets so as to enable such equipment to be used when poor soil conditions are encountered. Some of these attachments may be mounted directly on the bucket or scoop to break, cut, or rip through hardened material. The advantage of such a direct mounting is that the excavation operation may, for the most part, be carried out simultaneously with the ground breaking operation.

In order to concentrate the penetrating or earth breaking force of the bucket and ripper combination, many prior art devices utilize a single or primary ripper tooth as the earth breaking implement. Normally the ripper tooth is of a greater dimension than the earth working teeth which are carried or mounted on the bucket, being of a sufficient length to permit the ripper to extend beyond the cutting or digging edge of the bucket, and frequently greater in cross-sectional width or depth dimensions to provide increased structural strength.

Due to the localization of streses on the ripper tooth as it penetrates through the hardened ground, it is not only necessary that the ripper be strong, but is also important that its connection to the bucket be secure. However, because it is not always necessary to use the ripper attachment, the mounting should be simplistic enough to permit the equipment operator to quickly and easily attach or remove the assembly to or from the bucket respectively.

To simplify the mounting, several prior art devices utilize a single pivoted connector by which the ripper is attached to one portion of the bucket while a hooked, cupped, or friction type fit is used to support another portion of the ripper shank. In this manner, the ripper is quickly attached to the bucket using a single bolt or pin. However, such mountings have not provided for a complete or uniform distribution of the stresses across the bucket structure. Rather, the bulk of the stresses will frequently be imparted to a weaker structural member than the ripper tooth itself, as for instance, to the mounting pin or bolt or perhaps a portion of the edge of the bucket or bucket tooth.

Another problem often encountered when using ripper attachments has been that, in excavating trenches or ditches, the dirt walls are left rough and uneven. Such edging problems, although to a lesser degree, are frequently encountered when using the bucket alone. Therefore, side cutters, such as those disclosed in U.S. Pat. No. 3,748,762 to Tarrant, may be required on some types of buckets during normal trenching operations.

However, in order to correct such a problem when using ripper attachments, some means must be provided along both sides of the bucket to obtain a relatively even cut without greatly reducing the earth penetrating force being concentrated at a relatively localized area of ground by the earth breaking ripper tooth.

Some examples of the prior art include U.S. Pat. Nos. 2,783,558 to Morgan; 2,838,856 to Buisse; 3,039,210 to Slaughter; 3,097,439 to Calkin; and 3,724,899 to Clark.

SUMMARY OF THE INVENTION

The present invention is embodied in a ripper tool for an excavator type bucket or scoop which includes a mounting frame having a yoke portion which is frictionally engaged about the entire cutting edge of the bucket and a ripper mounting portion which extends from the yoke portion to the upper surface of the bucket and is releasably connected thereto. A side cutter tooth is mounted adjacent each side and along the lower edge of the mounting yoke and an enlarged ripper tooth is releasably mounted on the ripper mounting portion of the assembly.

It is the object of this invention to provide a ripper tool having at least one tooth which may be selectively mounted on a conventional excavator bucket for use in penetrating frozen, rocky, and other hardened earthen material in such a manner that the stresses imparted to the tooth during earth penetrating operations are more uniformly distributed across the bucket and to the bucket supporting members.

It is a further object of this invention to provide a detachably mounted ripper tool which may be quickly and securely attached to a conventional excavator bucket with a single pinned connection.

It is another object of this invention to provide a ripper tool for a backhoe or other such excavator bucket in which side cutting teeth are provided to permit even or clean trenching operations without decreasing the penetrating effectiveness of the ripper tool.

It is another object of this invention to provide a ripper tool for an excavator bucket in which side cutter teeth are provided to protect portions of the main frame of the ripper tool from possible damage which might otherwise occur due to stresses developed and/or abrasive materials encountered as the sides of the bucket and tool pass in contact with the side walls of the trench during operations.

BRIEF DESCRIPTION OF THE DRAWING

FIG. 1 is a side elevation of the invention mounted on a conventional excavator bucket.

FIG. 2 is a front view thereof.

FIG. 3 is a perspective view of the mounting frame portion of the invention.

FIG. 4 is an enlarged fragmentary section taken along the line 4—4 of FIG. 2.

DESCRIPTION OF THE PREFERRED EMBODIMENT

With continued reference to the drawing, a ripper mounting tool 10 is provided which is selectively secured to a conventional excavator or backhoe type bucket or scoop 11. The bucket 11 usually includes generally parallel opposing side walls 12 and 13 which are disposed on opposite sides of an arcuate back wall or bucket pan 14. The pan 14 forms the upper and lower edges 15 and 16 respectively of the bucket 11. Disposed along the lower edge of the bucket are a plurality of earth-working teeth 17 which loosen the soil being scooped into the bucket.

The bucket is operatively supported on a backhoe, tractor, or other such earth-working vehicle (not shown) via a boom 18 and a fluid cylinder 19. Relative movement between the bucket and the support and control members is accomplished by pivotal connections 20 and 21 with pairs of upstanding lugs 22 and 23 which extend outwardly along the upper surface of the bucket.

One of the primary concerns in the development of the ripper mounting tool 10 was to provide a device which may be selectively attached to and removed from the bucket and effectively distributes forces or stresses, encountered during earthworking operations, across the bucket 11 and to the supporting boom 18. With particular reference to FIG. 3, the tool 10 includes a generally T-shaped mounting frame 25 which has a yoke type first mounting portion 26 which is disposed generally perpendicular to a second mounting portion or ripper support arm 27.

The yoke or first mounting portion is generally rectangular in configuration having a forwardly and downwardly inclined upper wall 28, a bottom wall 29, and side walls 30 which define an open channel that is tapered inwardly from the back edge to the front edge 31 and 32 of the yoke, respectively. As will be apparent from the drawings, the tapered design of the yoke is such as to be complementary to and slidably receive the earth-working teeth 17 of the bucket. The fit between the yoke and the teeth may be somewhat loose to permit alignment of the second mounting portion of the mounting frame as will be discussed below. Further, to insure maximum contact of the tool 10 with the bucket 11, the yoke is preferably of sufficient dimension to extend around or encompass the plurality of earth-working teeth 17.

The second mounting portion or support arm 27 is welded or otherwise secured to the upper wall 28 of the yoke 26 and extends therefrom, across the opening or mouth of the bucket 11 to a pair of inner mounting brackets or lugs 13 which are fixed within the bucket. The inner mounting lugs 33 are disposed generally opposite the boom mounting lugs 22 along the upper portion and adjacent the upper edge 15 of the bucket. In order to reinforce the connection between the support arm 27 and the yoke 26, a pair of reinforcing webs 42 are connected between the side members 34 and 35 of the mounting arm and the upper surface 28 of the yoke.

The support arm 27 includes a pair of generally parallel side members 34 and 35 which are connected and reinforced by several spacers 36, and upper and lower generally parallel ripper tooth guide members 37 and 38. Two sets of opposed pin receiving holes 39 and 40 are provided through the side members. Further, the lowermost surfaces 41 of the support arm side members 34 and 35 are flush with the upper surface 28 of the yoke.

As is readily apparent, the mounting frame 25 is quickly and easily attached to the bucket 11 by inserting the yoke over and around the bucket teeth 17, as shown in FIGS. 1 and 2. The support arm 27 is subsequently secured to the inner mounting lugs 33 by inserting a pin, bolt or other such connector or retainer 43 through the holes 39 of the mounting arm and the lugs 33. Therefore, the cooperation between the pinned and yoked or frictional engagements of the mounting frame permit the bucket to be secured using the single pin 43.

Either before or after the mounting frame has been secured to the bucket, an enlarged ripper tooth 50 is inserted into the channel created by the ripper tooth guide members 37 and 38 and the mounting arm side members 34 and 35. A connector pin 51 is then inserted through the holes 40 in the mounting arm side members and through an aligned hole 52 in the upper portion of the ripper tooth shank.

As shown in the drawing, the ripper tooth is greater in dimension than the shovel or bucket teeth 17 and extends substantially below the same. The exact size of the ripper tooth will, of course, depend on the particular purpose for which the tool is to be used and therefore may vary considerably. Further, the tooth is provided with a replaceable shoe member 53 which is connected by a pin 54 to the toe of the ripper shank.

As previously pointed out, it is usually preferred to obtain a clean side wall cut when using a backhoe or similar excavator equipment. In order to adapt the ripper mounting tool 10 so that a clean side wall cut can be made, concurrently with the ripping operation, a pair of downwardly disposed side cutter teeth 55 are welded or otherwise secured to the bottom wall 29 of the yoke 26 adjacent the yoke side walls 30. The placement of the side cutter teeth is such that they are generally coextensive with the side walls 12 and 13 of the bucket and the side walls 30 of the yoke type mounting portion 26. Further, they are generally larger than the bucket teeth 17 and are shown as being smaller than the ripper tooth. Their size, however, may be varied depending upon their anticipated usage.

The side cutter teeth also provide a secondary function in that they aid in preventing damage to the yoke mounting portion 26 of the ripper tool. Specifically, as the tool is used, substantial stress is developed between the side walls 30 of the yoke mounting portion and the side walls of the trench being excavated. Such stress together with rocks and other earthen or abrasive material which are continuously encountered as the tool is used, may cause structural damage to the yoke portion of the tool, particularly along the area of the yoke side walls 30. As the side cutter teeth will initially cut through the earthen material in advance of the side walls of the yoke mounting portion of the ripper tool, the amount of stress and material resistance applied relative thereto will be significantly decreased.

Whatever size of side cutter teeth is used, they are placed or positioned so as to be behind the penetration portion of the ripper tooth shoe 53. Further, as can be seen in FIGS. 1 and 4, the plane defined by the bottom of each of the side cutter teeth is substantially even with a plane defined by the same portion of the ripper tooth. Therefore, during ripping operations, the ground will always be first or initially penetrated by the ripper tooth regardless of the foward angle of the bucket approach to the working surface. The side cutter teeth will not impact the ground until the ripper initially penetrates and loosens the hardened material. As the point or shoe of the ripper is the only portion of the tool making initial contact with the working surface, a maximum penetrating force is concentrated to a localized area, thus enhancing effective ground penetration.

To permit the side cutting teeth to be maintained in good working condition, replaceable shoes 56 are attached by pins 57 to the toe portion of the cutter teeth shanks.

During earth-working operations, should poor ground conditions be encountered, the ripper mounting assembly may be quickly attached to the excavator bucket or scoop. The equipment operator simply secures the mounting frame to the bucket by sliding the yoke portion of the frame around the bucket teeth. The fit between the yoke and the teeth will permit some play in the engagement so that the holes in the mounting arm side members may be aligned with the inner mounting brackets. Subsequently, a locking pin is inserted through the aligned holes and the mounting frame is then secured to the bucket. After the mounting frame has been attached, a ripper tooth is inserted and secured in position between the ripper tooth guide members.

The equipment is now ready for use in breaking through and excavating dense, rocky and frozen earth, or other such materials. As the ripper tooth is brought into engagement with a working surface, because the yoke portion of the mounting frame is engaged about the bucket teeth, the stresses transmitted through the ripper tooth are distributed across the outer digging or cutting edge of the bucket. Further, because the inner mounting lugs 33 are generally opposite the boom support connection, forces established along the support arm are transmitted directly through the tool's pinned connection with the bucket to the bucket support boom. Thus, the stresses developed during the excavation operation will be evenly distributed and transmitted through the bucket to the load bearing structure of the bucket support.

As the ripper penetrates through the material being worked, the bucket follows within the arcuate movement of the ripper tooth and scoops out the loosened material. Simultaneously, the side cutters insure that the walls of the excavated area are left clean and uniform while the possibility of damage to the yoke mounting portion of the ripper tool is decreased.

I claim:

1. A detachably mounted ripper tool for use with an excavator bucket having upper and lower surfaces, a vehicle boom support for the bucket connected to the upper surface of the bucket and a plurality of earth-working teeth disposed along the lower surface thereof, said ripper apparatus comprising, a generally T-shaped mounting frame means having first and second mounting means, said first mounting means having an upper wall, a bottom wall, and generaly parallel side walls which define an opening of a configuration to cooperatively receive the earth-working teeth of the bucket in a slidable engagement, said second mounting means being connected at one end to said upper surface of said first mounting means and extending therefrom across the mouth of the bucket means to releasably connect the other end of said second mounting means to the bucket, said means to connect said second bucket mounting means to said bucket including bracket means mounted to the inner surface of the bucket, retainer means selectively connecting said second bucket mounting means to said bracket, said bracket means being disposed generally opposite the connection of the bucket with the boom support means, ripper tooth means selectively connected to said second mounting means and extending outwardly therefrom beyond the earth-working teeth, and side wall cutter means mounted on said bottom wall and adjacent each side wall of said first mounting portion and extending outwardly therefrom.

2. An eatth-working implement for an excavator bucket having a working edge along the lowermost portion thereof and spaced side walls and which is attached along its upper and outer surfaces to a bucket support means, said implement comprising a generaly T-shaped frame means having first and second bucket mounting means, said first mounting means having upper and lower wall portions and a pair of side wall portions, said first mounting means being slidably mounted and extending substantially around the eatth-working edge of said bucket, said second mounting means being disposed generally perpendicular to said first mounting means and extending therefrom across the opening of the bucket, means to releasably connect one end of said second mounting means to the upper and inner portion of the bucket, the other end of said second mounting means being disposed along said upper wall portion of said first mounting means, means adjacent said other end of said second mounting means for receiving a ripper tooth means, and said ripper tooth means being selectively mounted so as to extend forwardly of and along a line generally parallel with the working edge of the bucket.

3. The structure of claim 2 in which said means to connect said one end of said second mounting means to said bucket includes bracket means mounted on the inner surface of the bucket, retainer means selectively connecting said one end of said second mounting means to said bracket means so that said second mounting means is disposed in alignment with the connection of the bucket with the bucket support means, whereby stresses directed along said second mounting means are transmitted through said bracket means to the bucket support means.

4. The structure of claim 2 including first and second side wall cutter means mounted on said lower wall portions of said first mounting means and extending downwardly and forwardly thereof, said first side wall cutter means being mounted adjacent one of said side wall portions of said first mounting means and said second side wall cutter means being mounted adjacent to the other of said side wall portions of said first mounting means so that said side wall cutters are disposed generally in alignment with the sides of the excavator bucket.

* * * * *